United States Patent [19]

Fuchigami et al.

[11] Patent Number: 4,598,756

[45] Date of Patent: Jul. 8, 1986

[54] METHOD FOR MAKING SAND MOLDS

[75] Inventors: Masao Fuchigami, Yawata; Yuichi Matsuo, Hirakata, both of Japan

[73] Assignee: Kabushiki Kaisha Komatsu Seisakusho, Tokyo, Japan

[21] Appl. No.: 647,198

[22] Filed: Sep. 4, 1984

[51] Int. Cl.[4] ..... B22D 15/00

[52] U.S. Cl. ..... 164/37; 164/207

[58] Field of Search ..... 164/15, 20, 37, 38, 164/40, 159, 169, 172, 207, 195, 196

[56] References Cited

U.S. PATENT DOCUMENTS 3,807,483 4/1974 Buhler ..... 164/38

FOREIGN PATENT DOCUMENTS 46-15227 4/1971 Japan ..... 164/37

55-24729 2/1980 Japan ..... 164/37

55-57353 4/1980 Japan .

57-142744 9/1982 Japan ..... 164/172

2019276 10/1979 United Kingdom ..... 164/37

*Primary Examiner*—Nicholas P. Godici

*Assistant Examiner*—G. M. Reid

*Attorney, Agent, or Firm*—Armstrong, Nikaido, Marmelstein & Kubovcik

[57] ABSTRACT

In a method of preparing a sand mold in which mold sand within a mold frame is squeezed from an upper side opposite to a lower side of the frame at which a pattern is embedded and also from said lower side, the squeezing from the lower side is made only after the squeezing from the upper side has been completed by about or more than 95% of a total squeezing stroke. The sand mold thus prepared comes to have a desired hardness particularly at casting surfaces thereof.

6 Claims, 19 Drawing Figures

METHOD FOR MAKING SAND MOLDS

BACKGROUND OF THE INVENTION

This invention relates to a molding method, more specifically it relates to a method of making sand molds having a high hardness particularly at and about pocket areas thereof (pocket areas being those generally located centrally of a sand mold and convexly shaped such as shown by numeral 1 in the accompanying drawing). In order to improve a hardness of casting surfaces particularly of pocket areas in addition to those areas of a sand mold which are located between a mold frame and a pattern and roots of which stand on a pattern plate (hereinafter called as the frame areas), it is knwon in Japanese preliminary patent publication Sho-No. 5557353 for example to have mold sand within a mold frame squeezed simultaneously or substantially simultaneously from both vertical sides thereof, viz., a side in which a pattern is bedded down (hereinafter called as the lower or pattern side) and also a side opposite to said lower or pattern side (hereinafter called as the upper or opposite side). In this way of squeezing, it is essential to hold a stroke for squeezing the mold sand from the lower side under strict control, so that joint end surfaces of the frame and the sand shall be brought to a same level. To wit, if the squeezing from the lower side is made until it reaches a pressure sufficient enough to squeeze completely the sand as a whole, it shall be extremely hard to bring the joint end surfaces of the mold frame and sand to a same level. On the other hand, the control or suppression of a squeezing stroke from the lower side as mentioned above, that is, to such extent that the mold frame and sand is assured of their joint bottom surfaces to be at a same level after squeezing, will afford only such pressure which is insufficient to squeeze the sand, especially pocket areas thereof sufficiently hard.

Besides the above problem, a squeezing operation of a sand mold from the lower side is accompanied with the following drawbacks. To wit, when a squeezing stroke from the lower side is made larger so as to increase a squeezing pressure, a gap is produced inevitably between circumferential sides of a pattern and inner circumferential walls of a mold frame, which allows mold sand to fall down thereto. A sealing means has to be provided for the pattern plate in this instance to compensate said gap, whereby the pattern plate becomes expensive. In this instance, an additional lower mold frame is often provided so as to compensate the difference of heights of end surfaces of the mold frame and sand.

In U.S. Pat. No. 3,807,483, there is disclosed that a pattern plate is slightly elevated vertically upward after having a cavity of a mold frame filled up with mold sand and having the sand molded therein pneumatically. In this disclosure, its molding is operated statically without any dynamic squeezing, and the vertical movement of the pattern plate is made so as to compensate stress of mold sand produced thereby within the mold frame cavity by having the sand escaped portionally from the cavity. This is not comparable to this invention which will be described hereinafter.

BRIEF SUMMARY OF THE INVENTION

In view of the above problems and drawbacks accompanied to the squeezing of sand from the upper and lower sides, particularly squeezing from the lower side, this invention is to provide a novel method of producing sand molds, in which a squeezing operation, even of a small stroke, from the lower side can afford to casting surfaces of molds, particularly those of pocket areas a desired hardness.

More specifically, this invention is to provide a method of making a sand mold in which mold sand within mold frame means is squeezed vertically from both sides thereof, viz., a pattern side at which a pattern is embedded and a side opposite to the pattern side, characterized in that squeezing of the mold sand from the pattern side is made after first squeezing from the opposite side has been completed at a distance near or of a full stroke of the entire squeezing operation.

BRIEF DESCRIPTION OF THE DRAWINGS

FIG. 4(*c*) is a veiw similar to FIG. 4(*a*) and shows the mold of FIG. 4(*b*) with the mold frames elevated;

FIG. 4(*d*) is a view similar to FIG. 4(*a*) and shows the mold of FIG. 4(*c*) with the mold moved further vertically upward;

FIG. 6(*b*) is a view similar to FIG. 6(*a*) and shows the mold of FIG. 6(*a*) with the mold moved vertically upward;

FIG. 6(*c*) is a view similar to FIG. 6(*a*) and showing the mold of FIG. 6(*b*) with the spacer withdrawn;

FIG. 6(*d*) is a view similar to FIG. 6(*a*) and showing the mold of FIG. 6(*c*) with the mold moved further vertically upward;

FIG. 7(*b*) is a view similar to FIG. 7(*a*) and shows the mold of FIG. 7(*a*) with the mold moved vertically upward;

FIG. 7(*c*) is a view similar to FIG. 7(*a*) and showing the mold of FIG. 7(*b*) with the mold frames elevated;

FIG. 7(*d*) is a view similar to FIG. 7(*a*) and showing the mold of FIG. 7(*c*) with the mold moved further vertically upward;

FIG. 8(*b*) is a view similar to FIG. (8*a*) and shows the mold of FIG. 8(*a*) with the squeeze head moved vertically downward; and FIG. 8(*c*) is a view similar to FIG. 8(*a*) and shows the mold of FIG. 8(*b*) after the mold has been moved vertically upward.

DETAILED DESCRIPTION OF THE PREFERRED EMBODIMENTS

Figure 1:
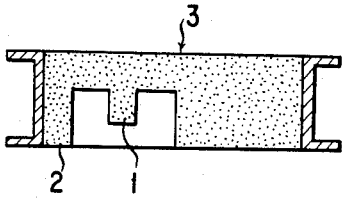
FIG. 1 is a sectional view of a sand mold to be pre prared in accordance with this invention.
Figure 2:
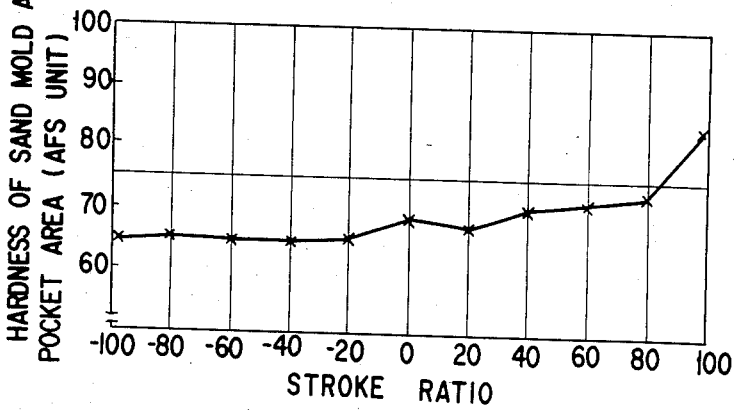
FIG. 2 is a graph showing hardness of pocket areas of molds prepared in accordance with this invention, in comparison with their hardness made by the conventional method.
Figure 3:
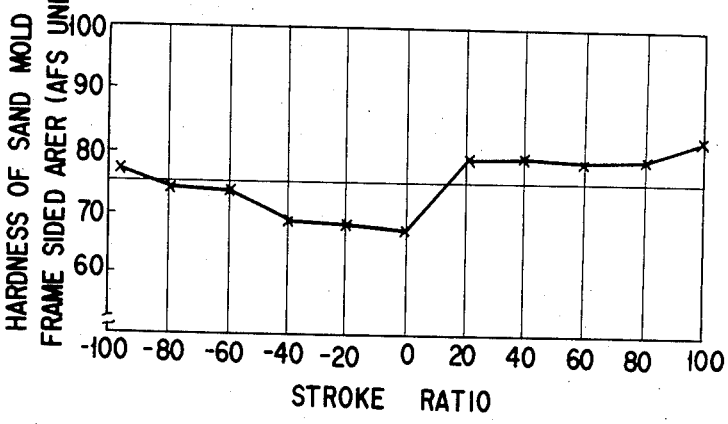
FIG. 3 is a graph same as FIG. 2 but showing hardness of frame areas adjacent to a mold frame, and FIG. 4(*a*) is a view partly in sections and shows the mold of the first embodiment of the invention after sand is introduced into the mold.

In this invention method briefly explained above, even through the squeezing from the lower side made under a small stroke, sand molds can have even hardness at casting surfaces, especially at pocket areas thereof. Effectiveness of this invention for affording to the casting surfaces including those of pocket areas of sand molds is explained hereunder with reference to FIG. 1. In preparing a sand mold 3 having a pocket area 1 and a frame area 2 adjacent to mold frame, the sequence of squeezing from the upper side and from the lower side was changed, while ratios of squeezes from the upper and lower sides in respect to a total squeezing stroke were variously selected. Resulting hardness at the pocket area 1 and frame sided area 2 are measured. In FIG. 2, there are shown resulting hardnesses at the area 1, and in FIG. 3 hardnesses at the area 2. In these figures, ordinates show hardness by AFS unit, and abscissas stroke ratios. Positive numerals on the abscissas show molding operations by squeezing from the upper side, followed by squeezing from the lower side, while negative numerals show those molding in which the squeezing from the lower side preceded the one from the upper side. For example, in case of the stroke ratio being expressed as 60, it is shown that 60% of a total squeezing stroke was made first from the upper side, followed by squeezing from the lower side of the remnant total stroke of 40%. And, in case of −80, it is shown that 80% of the total stroke was borne first by squeezing from the lowers side, followed by squeezing from the upper side of the remnant stroke of 20%. As shown in FIGS. 2 and 3, when a stroke ratio is more than 95 that is, first squeezing from the upper side of more than 95% of the total squeezing stroke which is followed by squeezing from the lower side of the remnant stroke of less than 5%, hardness of molds, especially at casting surfaces of pocket areas, was remarkably improved. The total squeezing stroke in the above was about 120–126 mm, while the amount of stroke of squeezing from the lower side was about 3–6 mm. It shall be apparent from the above that in this invention method, squeezing from the lower side of an extremely small amount of stroke compared to that from the upper side, can bring about even hardness of sand molds.

Figure 4:
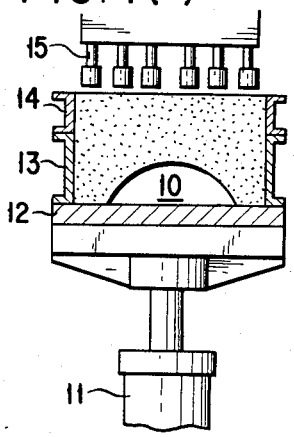
FIG. 4(*b*) is a view similar to FIG. 4(*a*) and shows the mold of FIG. 4(*a*) with the mold moved vertically upward.
Figure 4:
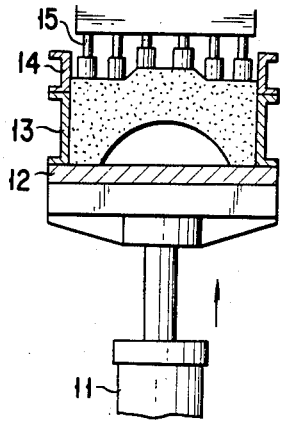
Figure 4:
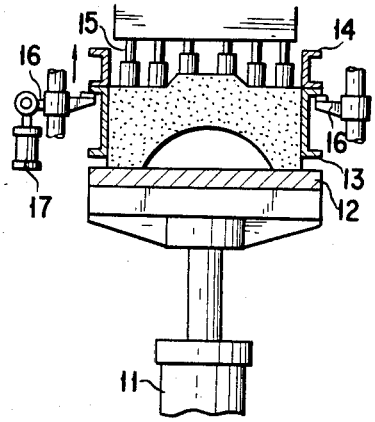
Figure 4:
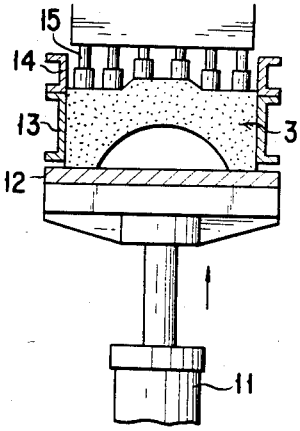

In FIG. 4, which shows the first embodiment of this invention method, upon a squeeze cylinder 11, there are mounted a pattern plate 12 with a pattern 10 on one side thereof, a main mold frame 13, and an upper supplementary or additional frame 14. Mold sand is introduced within the frames 13 and 14 [FIG. 4 (*a*)]. Then, the squeezing cylinder 11 is moved vertically upward by about 120 mm, whereby squeezing from the upper side is made first by means of segment squeeze heads 15 [FIG. 4(*b*)]. When this squeezing from the upper side has completed, the mold frame 13 together with the upper supplementary frame 14 is elevatated about 5 mm by means of lifters 16, leaving the mold sand as it is on the pattern plate [FIG. 4 (*c*)]. The lifters 16 are operated by cylinders 17 which move vertically upward and downward. The squeeze cylinder 11 is again lifted about 3 mm, whereby squeezing from the lower side is performed and molding is completed.

Figure 5:
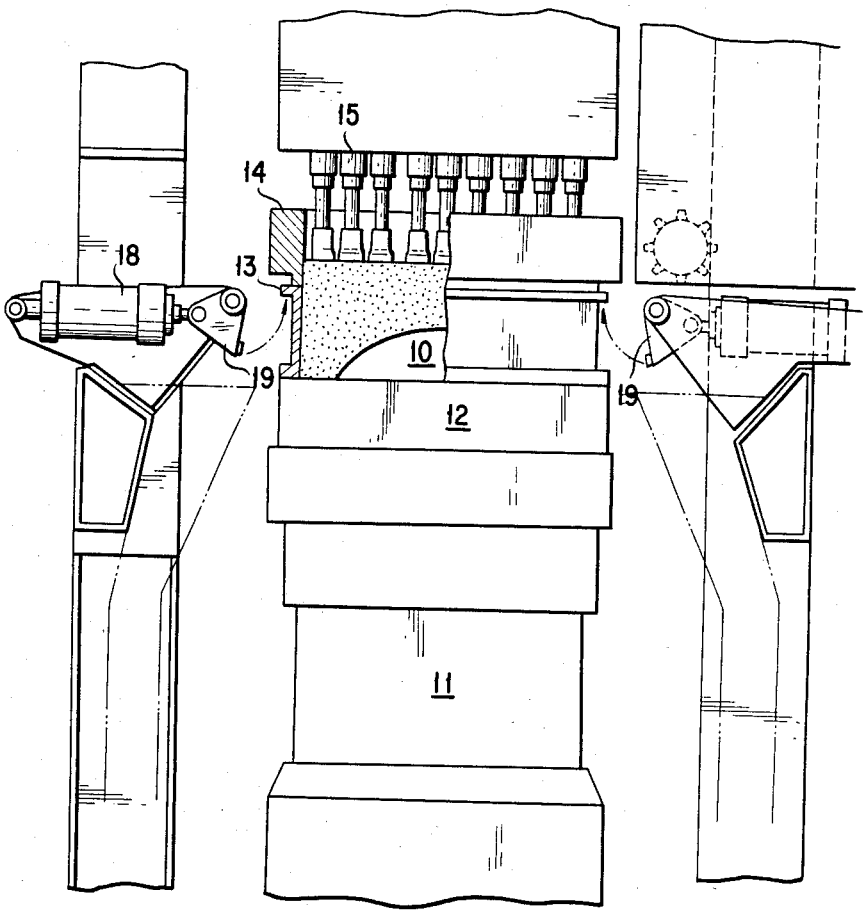
FIG. 5, partly in sections, shows another embodiment of the lifter of FIG. 4.
Figure 6A:
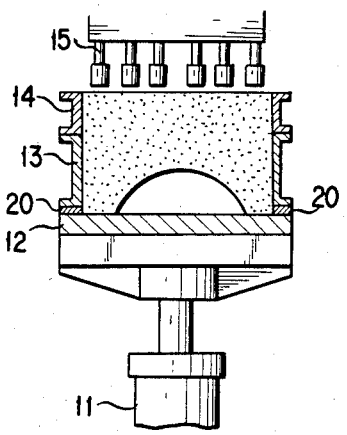
FIG. 6(*a*) is a view, partly in sections, of a second embodiment of the invention and shows the mold of the second embodiment after sand is introduced.
Figure 6B:
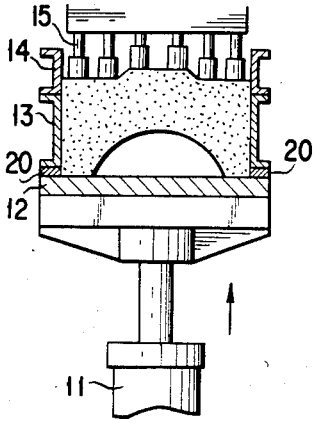
Figure 6C:
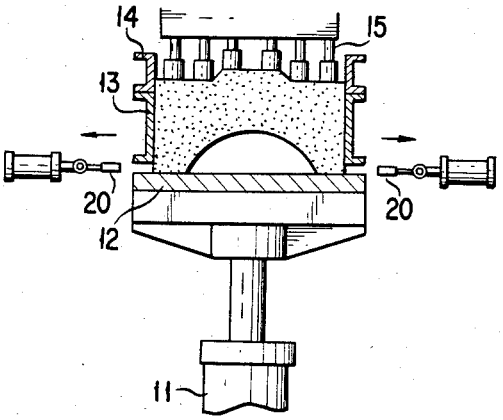
Figure 6D:
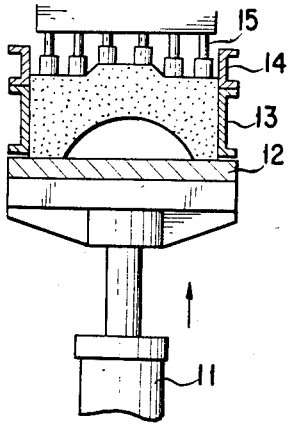
Figure 7A:
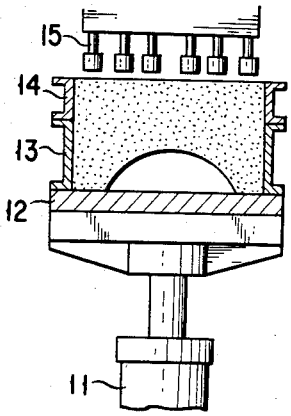
FIG. 7(*a*) is a view, partly in sections, of a third embodiment of the invention and shows the mold of the third embodiment after sand is introduced.
Figure 7B:
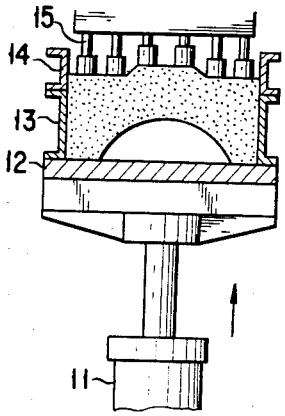
Figure 7C:
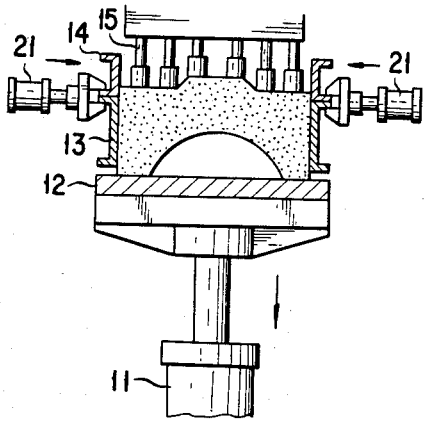
Figure 7D:
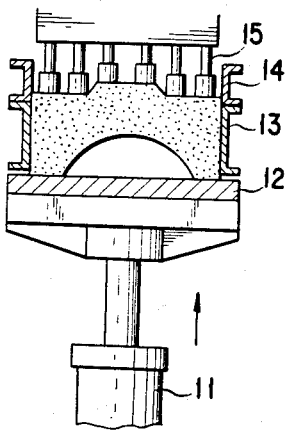

In FIG. 5, there is shown another embodiment of the lifters 16. Here, clyinders 18 which operate horizontally are employed. The cylinders 18 actuate brackets 19 so as to rotate, forward ends of which brackets work to elevate the mold frame 13.

In FIG. 6, there is shown the second embodiment of this invention method. The mold frame 13 is mounted on the pattern plate 12 with a spacer plate 20 of about 5 mm in thickness therebetween [FIG. 6 (*a*)]. When squeezing from the upper side of about 120 mm stroke by means of the segment squeeze heads 15 is finished, the spacer 20 are withdrawn [FIG. 6 (*c*)]. And, then, squeezing from the lower side of about 3 mm stroke is effected [FIG. 6 (*d*)].

In FIG. 7 which shows the third embodiment of this invention method, when squeezing from the upper side of about 120 mm stroke is completed [FIG. 7 (*b*)], the mold frame 13 and the supplementary frame 14 are held at their positions by mold-locking cylinders 21, and the squeeze cylinder 11 is lowered about 5 mm so as to have the mold sand slid in relation to the stationarily held mold frame 13 [FIG. 7 (*c*)]. Then, the squeeze cylinder 11 is elevated again about 3 mm, whereby squeezing from the lower side is effected [FIG. 7 (*d*)].

Figure 8A:
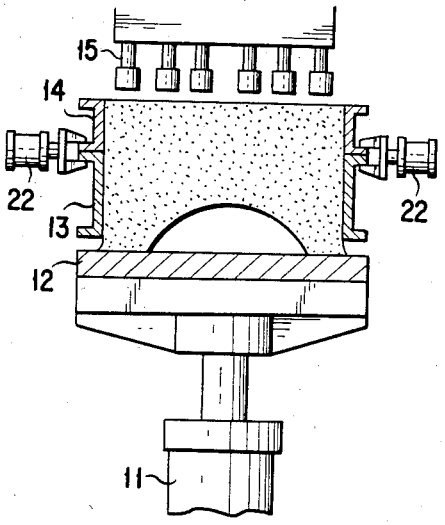
FIG. 8(*a*) is a view, partly in section, of a fourth embodiment of the invention and shows the mold of the fourth embodiment after sand is introduced.
Figure 8B:
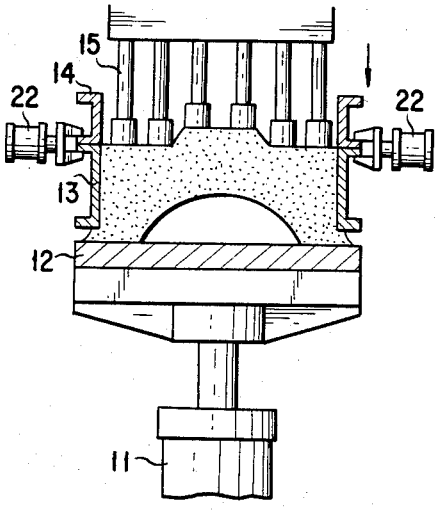
Figure 8C:
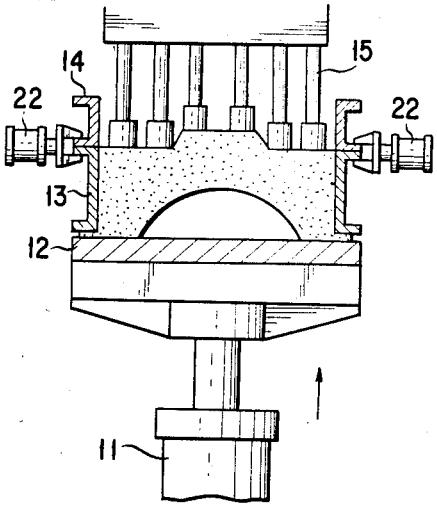

FIG. 8 shows the fourth embodiment of this invention method, in which the mold frame 13 is held by mold frame fixing lifters 22 at an elevated position of a distance of about 5 mm from the pattern plate [FIG. 8 (*a*)]. Squeezing from the upper side is down by having the segment squeeze heads 15 descended about 120 mm [FIG. 8 (*b*)]. Then, squeezing from the lower side is made by the elevation of the squeeze cylinder 11 about 3 mm.

It shall be noted from the above described embodiments that in this invention method, contrary to certain conventional methods in which patterns are located on a pattern plate while mold frames are sustained by another plate, all the squeezing is performed by mold frames and patterns which are unanimously located on a single pattern plate, whereby a hazardous operation for bringing about the patterns and the mold frames to a same level during molding is eliminated. In addition, since second squeezing from the lower side is made, in this invention, at a small amount of stroke and only after the completion of first squeezing from the upper side which shall have mold sand compacted very tightly before the second squeezing, there is no fear that during the second squeezing, mold sand, bottom part of which is not sustained by a mold frame, shall flow outwardly under the mold frame. Further in addition, since second squeezing is made only after the completion of first squeezing, casting surfaces which have been tightly compacted outwardly from a pattern by the first squeezing, are further recompacted by the second squeezing inwardly from the pattern so that evenly smooth casting surfaces are obtainable.

We claim:

1. A method of making a sand mold with mold sand in a mold frame surrounding a pattern resting on a pattern plate at the pattern plate side of the mold, the pattern plate extending beyond the periphery of the mold frame and forming a support for the mold frame and a closure for the bottom side of the mold, the mold frame at the top side of the mold, opposite to the pattern side, being open and a squeeze head means above the open top of said mold, the steps comprising, lifting said mold frame, with said sand and said pattern therein, with said pattern plate to engage the top surface of the mold sand therein with said squeeze head means, continuing said lifting of said mold frame, said mold sand and said pattern until said mold sand is squeezed in said mold frame not less than fifty (50) percent of the full squeeze stroke, stopping said lifting of said pattern plate, said mold frame, said mold sand and said pattern and, without moving said pattern plate, said mold sand or said pattern relative to each other, forming a gap between the bottom end of said mold frame and said pattern plate a distance slightly greater than the remainder of said full squeeze stroke and, with said bottom end of said mold frame and said pattern plate separated, advancing said pattern plate toward said mold frame the remainder of said full squeeze stroke to squeeze the bottom of said sand mold.

2. A method as claimed in claim 1 characterized by having the mold frame means comprised of a main mold frame and a supplementary mold frame, and mounting the supplementary mold frame on the main mold frame.

3. A method, as claimed in claim 1, in said gap between the bottom end of said mold frame and said pattern plate is formed by lifting said mold frame relative to said pattern plate and said mold sand thereon a distance slightly greater than the remainder of said full squeeze stroke.

4. A method as claimed in claim 7, in which said mold frame is supported on said pattern plate on a spacer plate and said spacer plate is removed from between said mold frame and said pattern plate to form said gap between said mold frame and said pattern plate.

5. A method as claimed in claim 7, in which said gap is formed between the bottom end of said mold frame and said pattern plate by holding said mold frame and pushing said pattern plate, said mold sand and said pattern therein downwardly with said squeeze head means a distance relative to said held mold frame slightly greater than the remainder of said full squeeze stroke and, thereafter, advancing said pattern plate toward said mold frame said remainder of said full squeeze stroke.

6. A method as claimed in claim 7, in which said mold frame is held, with said sand and pattern therein, the surface of said sand opposite to said pattern plate is engaged with said squeeze head means and said mold sand is squeezed in said mold frame not less than fifty (50)percent of the full squeeze stroke and a gap is formed between the bottom end of said mold and said pattern plate slightly greater than the remainder of said full squeeze stroke and, with said bottom end of said mold frame and said pattern plate separated, advancing said pattern plate toward said mold frame the remainder of said full squeeze stroke to squeeze the bottom of said sand mold.

* * * * *